US005419224A

United States Patent [19]

Gamperling et al.

[11] Patent Number: 5,419,224

[45] Date of Patent: May 30, 1995

[54] DEVICE FOR THE CONTROLLED REMOVAL OF PIECES OF WASTE MATERIAL

[75] Inventors: Peter Gamperling, Bammental; Richard Mack, Brühl; Rainer Klenk, St. Leon-Rot, all of Germany

[73] Assignee: Heidelberger Druckmaschinen AG, Heidelberg, Germany

[21] Appl. No.: 114,537

[22] Filed: Aug. 31, 1993

[30] Foreign Application Priority Data

Sep. 5, 1992 [DE] Germany ..... 42 29 699.4

[51] Int. Cl.[6] ..... B26D 1/36

[52] U.S. Cl. ..... 83/100; 83/98; 83/152; 83/331

[58] Field of Search ..... 83/98, 100, 152, 331

[56] References Cited

U.S. PATENT DOCUMENTS

| | | | |
|---|---|---|---|
| 3,274,871 | 9/1966 | Ehlscheid | 83/99 |
| 3,380,327 | 4/1968 | Stemmler | 83/100 |
| 3,548,696 | 12/1970 | Hornung | 83/100 |
| 3,611,855 | 10/1971 | Thousand, Jr. | 83/100 |
| 3,698,272 | 10/1972 | Kesten et al. . | |
| 3,952,637 | 4/1976 | Lamnbert et al. . | |
| 4,276,800 | 7/1981 | Koppa et al. | 83/100 |
| 4,407,870 | 10/1983 | Clerc et al. | 428/1 |
| 4,409,870 | 10/1983 | Rynik et al. | 83/100 |
| 4,480,516 | 11/1984 | Leroy | 83/98 |
| 4,671,152 | 6/1987 | Blümle | 83/152 |
| 4,823,659 | 4/1989 | Falasconi | 83/100 |
| 5,127,292 | 7/1992 | Kappor | 83/98 |
| 5,140,880 | 8/1992 | Littleton | 83/98 |

FOREIGN PATENT DOCUMENTS

| | | | |
|---|---|---|---|
| 468254A2 | 1/1992 | European Pat. Off. . | |
| 1467851 | 2/1967 | France | 83/100 |
| 1194875 | 11/1967 | Germany . | |
| 1928966 | 2/1970 | Germany . | |
| 2164554 | 6/1973 | Germany . | |
| 2446722 | 4/1976 | Germany . | |
| 3202264A1 | 8/1983 | Germany . | |
| 3317763A1 | 12/1983 | Germany . | |
| 3243778 | 5/1984 | Germany . | |
| 8715419 | 4/1989 | Germany . | |
| 4023257 | 1/1992 | Germany . | |

*Primary Examiner*—Kenneth E. Peterson
*Attorney, Agent, or Firm*—Kenyon & Kenyon

[57] ABSTRACT

A device for the controlled removal of pieces of waste material is provided. The device has a non-rotatable cylinder shaft having an outer surface; a cylinder jacket having an inner surface and an outer surface and having at least one through-hole extending between the inner surface and the outer surface of the cylinder jacket, the cylinder jacket rotatable around the cylinder shaft; and sealing strips between the outer surface of the cylinder shaft and the inner surface of the cylinder jacket. The outer surface of the cylinder shaft, the inner surface of the cylinder jacket and the sealing means define a pressure chamber and a vacuum chamber, so that upon rotation of the cylinder jacket around the cylinder sleeve the at through-holes alternately connect with the pressure chamber and the vacuum chamber. The waste pieces are created when a pair of knives disposed on the outer surface of the cylinder jacket cut a moving web.

13 Claims, 5 Drawing Sheets

DEVICE FOR THE CONTROLLED REMOVAL OF PIECES OF WASTE MATERIAL

FIELD OF THE INVENTION

The present invention relates to a device for the controlled removal of pieces of waste material, in particular on a cutting cylinder.

BACKGROUND INFORMATION

From the prior art, DE 32 43 778 A1, a suction air cylinder having a control head for the suppression of noise is known. Through a large number of holes arranged in the jacket of the suction cylinder, a material is aspirated which drops off from the jacket after an atmospheric pressure equalization effected by a control head. In order to suppress the noise upon the abrupt pressure equalization, the suction cylinder is divided into several chambers. In this device, the detaching of the material from the jacket of the suction cylinder takes place merely by atmospheric pressure equalization.

DE 1 19 48 75 discloses a device for feeding properly-positioned paper sheets to a machine for the processing of blanks. The suction member, formed as a suction drum, comprises a chamber which is permanently under the action of suction and a second suction chamber which can be subjected to suction action in controlled manner. The action of the suction air takes place at an end side of the suction drum. The jacket, which is perforated by the individual holes, rotates together with the drum; an action of blast air on the jacket of the drum is not provided.

Finally, U.S. Pat. No. 4,409,870 shows a cutting device for the continuous cutting and removal of thin strips of a printed web. The strip which has been cut off by a pair of knives cooperating with a bottom knife is aspirated by vacuum and passes into a central hole of the cutting cylinder from which it is subsequently removed.

This device has the disadvantage that it requires a large volume of suction in order to convey the strips into the inside of the cylinder. Furthermore, this device is subject to limitations with respect to the circumferential speed since the centrifugal forces which are produced upon high circumferential speeds and which act on the strip must be additionally compensated for by the vacuum present in the duct. For high speeds the conveyance paths into the inside of the cutting cylinder therefore are too long.

OBJECTS AND SUMMARY OF THE INVENTION

An object of the invention is to reliably grasp pieces of waste material during and after cutting of the material, independent of the specific weight of the material.

A further object is to keep the air volumes required for reliable grasping and disposal small, thereby improving performance.

This object is achieved in accordance with the present invention by the fact that a device for the controlled removal of pieces of waste material, in particular on a cutting cylinder, has the following features: a non-rotatable cylinder shaft having an outer surface; a cylinder jacket having an inner surface and an outer surface and having at least one through-hole extending between the inner surface and the outer surface of the cylinder jacket, the cylinder jacket rotatable around the cylinder shaft; and means for sealing the outer surface of the cylinder shaft and the inner surface of the cylinder jacket; the outer surface of the cylinder shaft, the inner surface of the cylinder jacket and the sealing means defining a pressure chamber and a vacuum chamber, so that upon rotation of the cylinder jacket around the cylinder sleeve the at least one through-hole alternately connects with the pressure chamber and the vacuum chamber.

An advantage inherent in this solution resides in the fact that a reliable functioning at the highest production speeds is assured due to small reversible air volumes.

A further advantage is that a reliable grasping of the waste strip takes place immediately during the cutting, and a dropping off of the waste strip occurs within a well-defined zone.

Another advantage is that since blast air and vacuum are applied permanently, the switch times for the switching of the types of air are minimal.

A still further advantage is that valves and also other switch arrangements can be substantially dispensed with since the switching of the types of air is effected by the rotation of the cylinder jacket relative to the cylinder shaft which can be fixed in position.

One other advantage is that high manufacturing accuracy assures minimal leakage losses both upon the action of blast air and upon the drawing in of outside air when the cylinder jacket is acted on by vacuum.

In an advantageous further development of the object of the invention, the chambers extend parallel to the cylinder shaft essentially over the length of the cutting cylinder. This results in a uniformly applied action on the surface of the cylinder jacket both by blast air and by vacuum for handling waste strips of the most varied stock thicknesses starting with thin papers of 40 $g/m^2$, which tend to flutter, up to thicker material of about 200 $g/m^2$.

It is furthermore provided that the chambers be limited by at least one sealing strip which can be variably fixed in position in circumferential direction on the cylinder shaft. In this way, the length of the chambers can be shortened or lengthened depending on the requirements. The chambers form circular sectors on the cylinder shaft in the circumferential direction which favors a simple and cost-favorable feeding of blast air or action of a vacuum through holes in the cylinder shaft.

It is furthermore provided that the cylinder shaft can be variably fixed in its position of rotation by a torque support. This permits on the one hand the fixing of a defined position of the cylinder shaft which the latter will maintain even during production. On the other hand, sensitive turns of the cylinder shaft can be effected after loosening the clamping screw on the torque support. In this way, an adjustment of the position of the chamber between cylinder shafts and rotatably mounted cylinder jacket can be effected.

In a favorable development of the basic concept of the invention, the cylinder jacket is arranged via bearings in a separately drivable manner on the cylinder shaft. The driving of the cylinder jacket arranged on the cylinder shaft is effected by a belt pulley which is arranged on a cylinder pin. This drive configuration permits the utilizing of the rotating cylinder jacket as switch element for changing the types of air with which the holes on the circumference of the cylinder jacket are acted on. Valves or throttles can be entirely dispensed with since the blast air chamber and the suction air chamber are permanently acted on and the switching of the air is effected merely by rotation of the cylinder jacket on the cylinder shaft which takes up the sealing strips for the separation of the chambers.

Further developments of the basic concept of the invention provide for at least one pair of knives, which comprises a number of holes, to be attached to the circumference of the cylinder jacket. In the area of the pair of knives, on both sides of the holes between the cutting edges of the knives there is formed a transport surface for waste pieces.

This has the advantage that the waste strip which is to be separated from the web of paper is drawn against the cylinder jacket through the holes in the latter already after the cutting by the first of the knives of the pair of knives. After completion of the cut by the second knife of the pair of knives by means of a stationary lower knife, the waste strip can be completely drawn against the transport surface which considerably increases the reliability of conveyance in the device of the invention.

Finally, the pairs of knives consist of one-piece knives which extend in axial direction over the entire length of the cylinder jacket. This guarantees a uniform course of the cut and easier adjustment during the preliminary adjusting.

Above the cutting cylinder, a suction device picks up waste pieces from the cylinder jacket of the cutting cylinder. The suction device supports the taking over of the waste strip which has been detached from the cylinder jacket by the action of blast air. Since centrifugal force acts in addition on the waste strip, a reliable taking over into the suction device is assured. The contour of the blast air chamber in the circumferential direction on the cylinder shaft agrees in advantageous manner with the region opposite which there is the exhaust opening of the suction device on the circumference of the cutting cylinder.

BRIEF DESCRIPTION OF THE DRAWINGS

The invention will be explained in greater detail below with reference to the drawing, in which.

DETAILED DESCRIPTION

Figure 1:
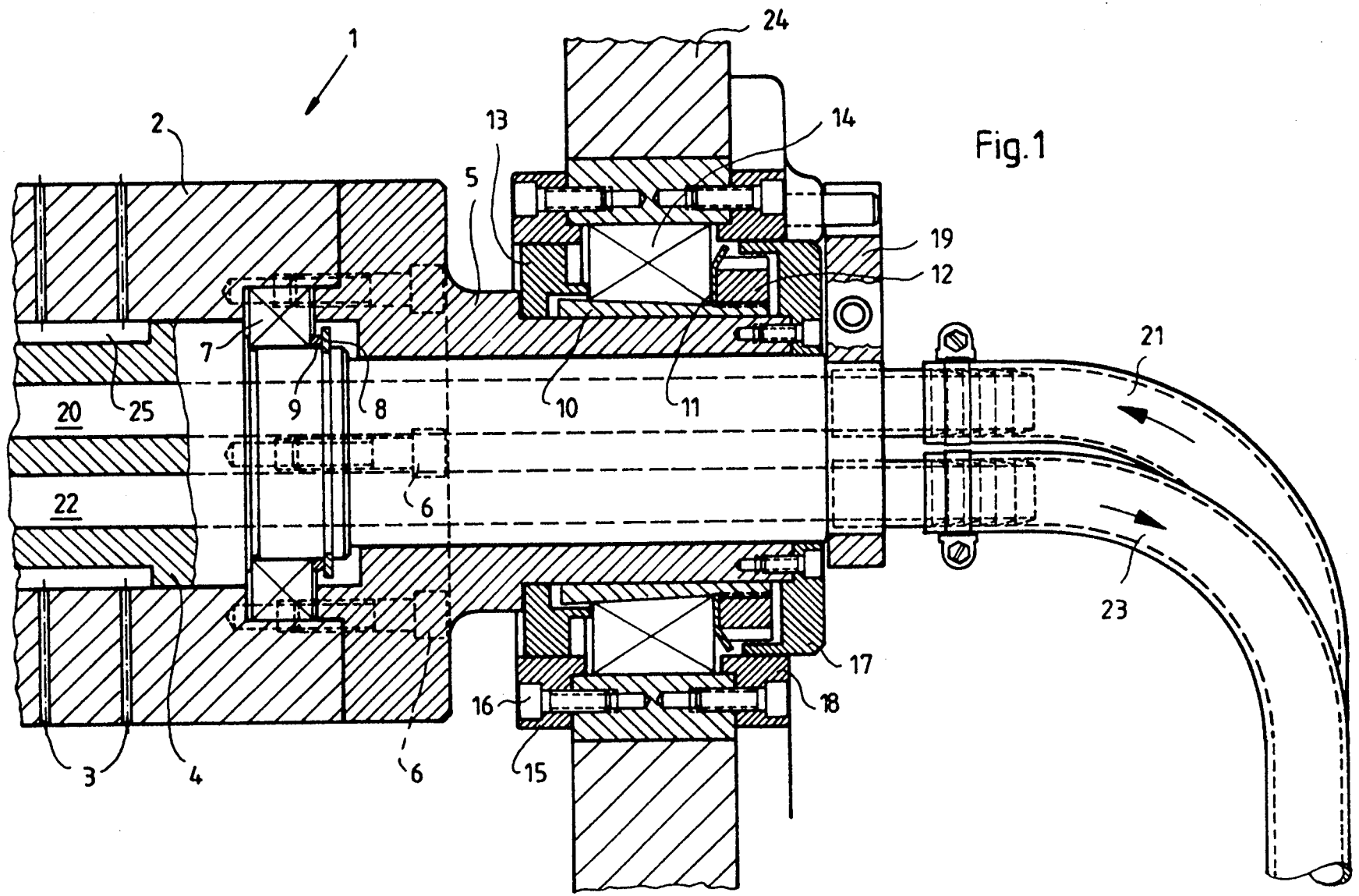
FIG. 1 shows the mounting of a cutting cylinder on the operator side.

FIG. 1 shows the mounting of a cutting cylinder on the operator side.

A cutting cylinder 1 consists of a cylinder jacket 2, which is perforated by at least two rows of holes 3 extending axially along the length of the cylinder jacket, and a cylinder shaft 4. A cylinder pin 5 is connected to the cylinder jacket 2 by screws 6.

Between the cylinder pin 5 and a shoulder of the cylinder shaft 4, a bearing 7 is fixed in its axial position on the cylinder shaft 4 by a retaining ring 8 and a spacer ring 9. Due to the mounting of the cylinder jacket 2 on the cylinder shaft 4, rotation of the cylinder jacket 2 relative to the cylinder shaft 4 is possible. On the cylinder pin 5 there is provided a cone 10 on which an antifriction bearing 14 is seated which in its turn is fixed in its position on the cone 10 by a nut 12 and locking plate 11.

Figure 2:
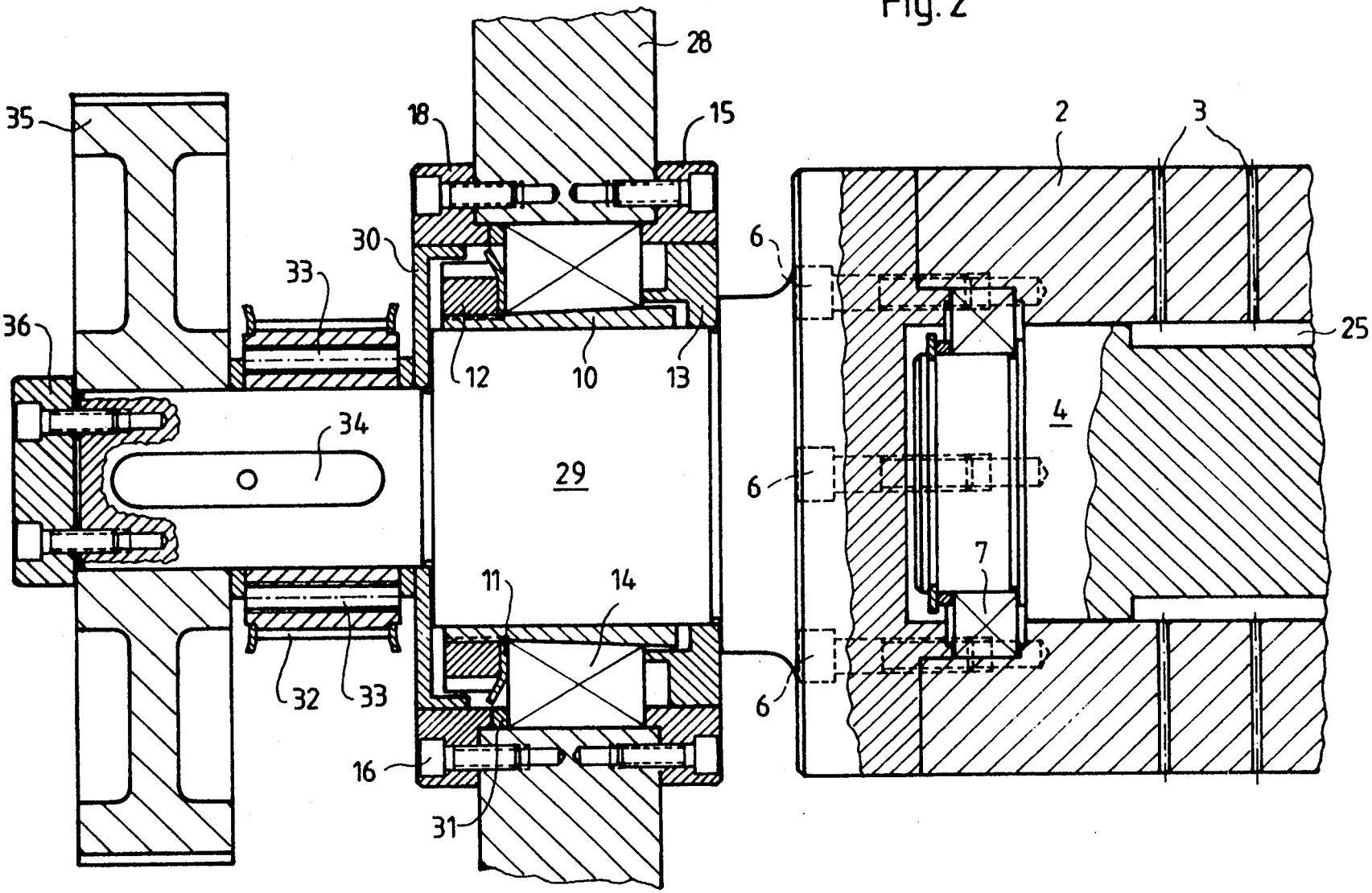
FIG. 2 shows the mounting of a cutting cylinder on the drive side.

The cylinder jacket 2 is thus received rotatably in a bushing of a sidewall 24 via the cylinder pins 5, the cone 10 and the antifriction bearing 14, while the cylinder shaft 4 which passes through the cylinder pin 5 and the cylinder jacket 2 does not rotate. Between the region of the cylinder shaft 4 which is perforated by the blast and suction air holes 20 and 22 respectively shown here in dashed line—and the cylinder pin 5 there is therefore freedom from contact. On the cylinder side, the antifriction bearing 14 rests against a ring 13 which is supported on a shoulder of the journal pin 5. The ring 13 which serves as a seal or the ring 30 in FIG. 2 is surrounded by the bearing housing 15 on the cylinder side which is held by screws 16 in a bushing of the sidewall 24. A cover 17 is connected to the end side of the cylinder pin 5 by screws. The cover 17 is surrounded by a bearing housing 18 which is attached on its end side in a bushing in the sidewall 24. Accordingly, upon the rotation of the cylinder jacket 2, both the ring 13 and the cover 17 rotate relative to the bearing housings 15 and 18 which are fixed in the sidewall and from which they are separated by narrow air gaps. In addition to this, a torque support 19 is attached to the sidewall 24 and keeps the cylinder shaft 4 at rest via a clamp. The torque support 19 surrounds the cylinder shaft 4 in the region in which the connections for the blast air feed line 21 and the suction air feed line 23 lie. The latter act in each case on the blast air hole 20 or the suction air hole 22 which pass through the cylinder shaft 4 up to about the center of the shaft. Through the blast air hole 20 or the suction air hole 22 the sectors of an annular chamber 25 between the cylinder shaft 4 and the inner side of the cylinder jacket 2 are acted on by blast air or suction air.

The torque support has the function to keep the cylinder shaft 4 at rest so that its position will not be changed for instance by bearing friction. However, the circumferential position of the cylinder shaft 4 can be varied by the clamp provided on the torque support whereby it is made possible to affect the suction and blast function of the cutting cylinder 1.

FIG. 2 shows the mounting of the cutting cylinder on the drive side.

Due to a bearing 7 on the drive side of the cylinder shaft 4, the cylinder jacket 2 is rotatable on the cylinder shaft 4. A cylinder pin 29 is connected to the cylinder jacket 2 by screws 6. On the cylinder pin 29 there is fastened—analogous to FIG. 1—a cone 10 on which an antifriction bearing 14 is arranged by the locking plate 11 and the nut 12. The outer ring of an antifriction bearing 14 is held in position by the bearing housings 15 and 18 which are each received via screws 16 in a sidewall 28 on the drive side. In addition, a drive wheel 35 which introduces the drive and a belt pulley 32 are mounted fixed for rotation on the extension of the cylinder pin 29. The drive wheel 35 and the belt pulley 32 are received fixed for rotation by an adjusting spring 34. Disassembly of the drive wheel 35 and of the belt pulley 32 can take place after removal of a cover 36 from the cylinder pin 29. For the removal of the belt pulley 32 from the cylinder pin 29 the belt pulley is provided with two threads 33.

Figure 3:
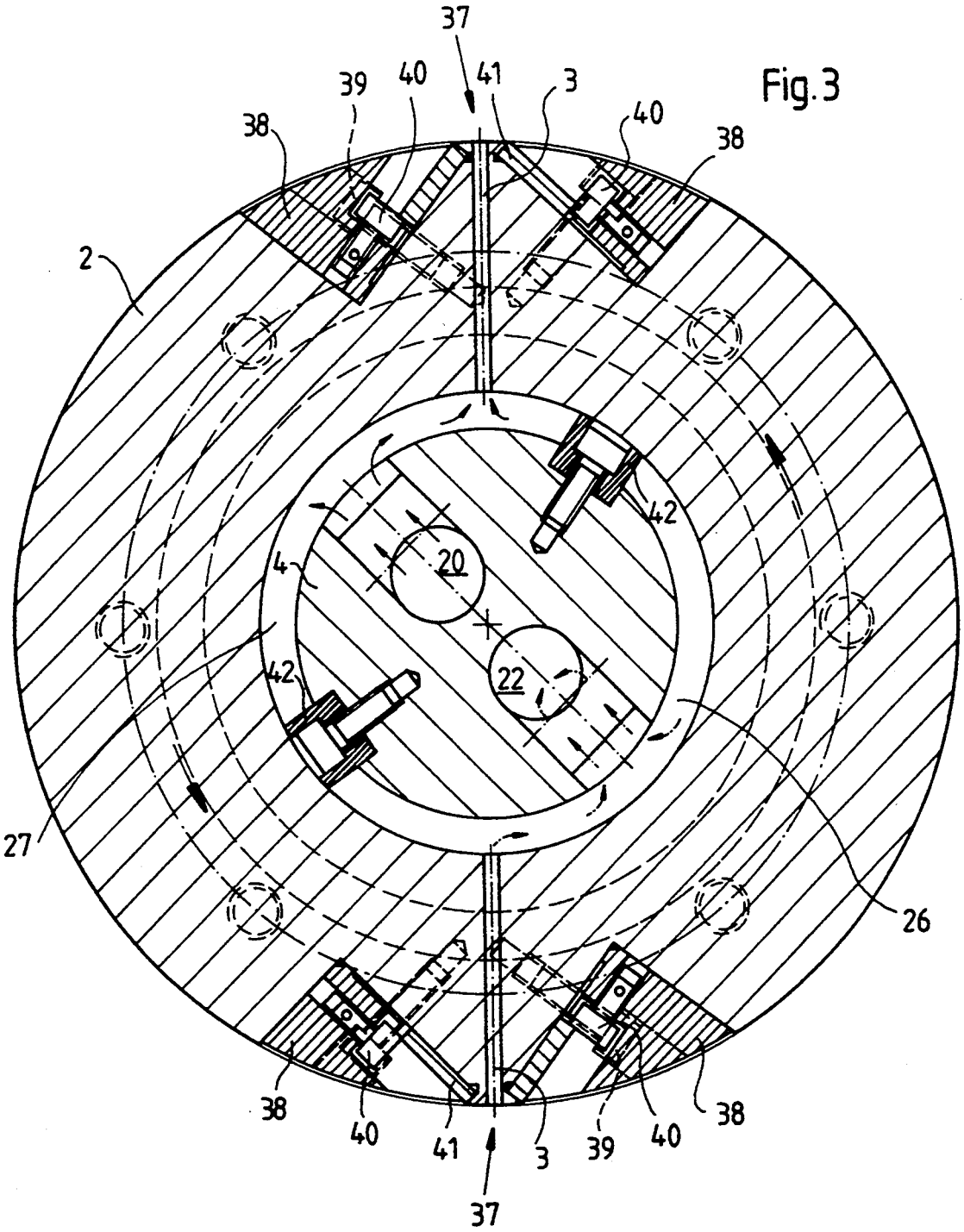
FIG. 3 is a cross section through the cylinder jacket and the cylinder shaft.

FIG. 3 is a cross section through cylinder jacket and cylinder shaft of a cutting cylinder.

It can be noted from this figure that the cylinder shaft 4 has within it the blast air hole 20 and the suction air hole 22 which extend axially up to about the middle of the cutting cylinder 1. Sealing strips 42 are attached by screws on the circumference of the cylinder shaft 4, the position of said sealing strips on the circumference of the cylinder shaft 4 limiting a pressure chamber 27 and a suction chamber 26. With respect to their circumference, these chambers are limited by the inside of the cylinder jacket 2 which in its turn is passed through by rows of holes. Therefore, when a row of the holes 3 is in contact with the pressure chamber 27, blast air flows to the circumference of the cylinder jacket 2; if a row of holes 3 of the cylinder jacket is connected to the suction chamber 26, vacuum is applied to the openings of the holes 3 on the cylinder jacket 2. The holes 3 exit at the surface of the cylinder jacket 2 in each case between a pair of knives 37, comprising two knife holders 38 which receive one knife 41 each. The knife holders 38 are fixed in position via holding screws 39 on the cylinder jacket 2. The knifes 41 shown here are made of one piece and can be adjusted in such a manner by set screws 40 that the positions of the cutting edges of the knifes 41 relative to the outer surface of the cylinder jacket 2 or a stationary bottom knife can be set extremely precisely. It would therefore be conceivable to have these set screws 40 turned by servomotors provided in the cylinder jacket 2 in order to be able to effect this adjustment. Four cutting edges can be developed on the knives 41 which are in this case of rectangular cross section so that the service life of the knives 41 is favorably affected. In addition to the geometry of the knives 41 shown here, it is also conceivable to clamp in the knife holder 38 knife bodies with merely one well-defined cutting edge of some other geometry.

Since the cylinder jacket 2 rotates relative to the cylinder shaft 4, the rows of holes 3 are alternately brought into contact with the pressure chamber 27 and the suction chamber 26, which results in an alternating switching of the air from suction air to blast air and vice versa during the rotation of the cylinder jacket 2. By a change in the positions of the sealing strips 42 which limit the chambers 26 and 27, the areas of action of the suction air and blast air can of course be adapted to individual requirements and the sealing strips 42 can furthermore be provided with spring supports in order to achieve a self-adjusting sealing.

Figure 5:
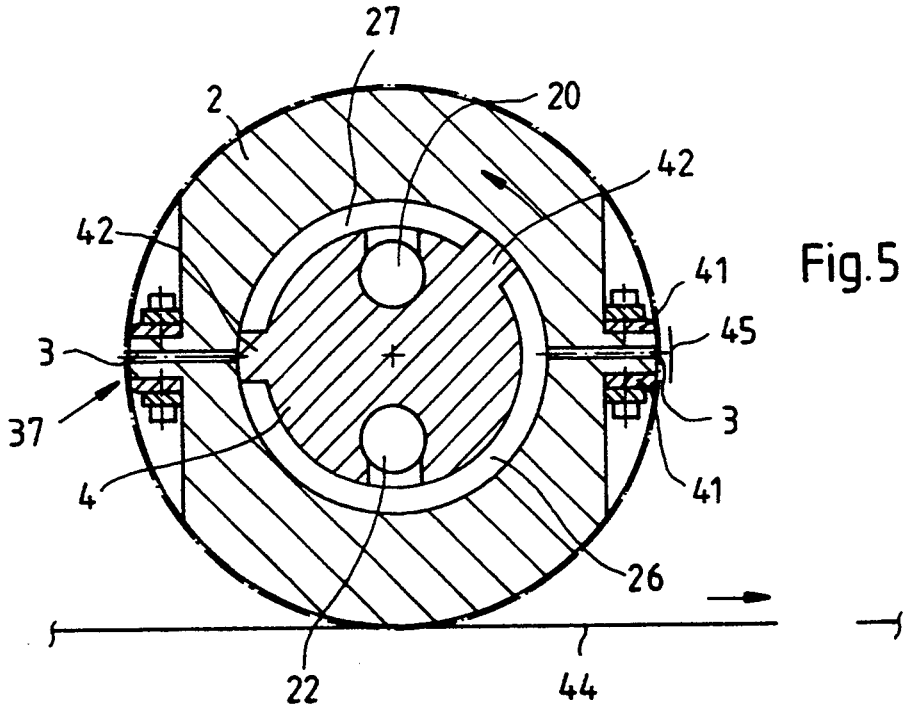
FIG. 5 shows a waste piece being conveyed.
Figure 6:
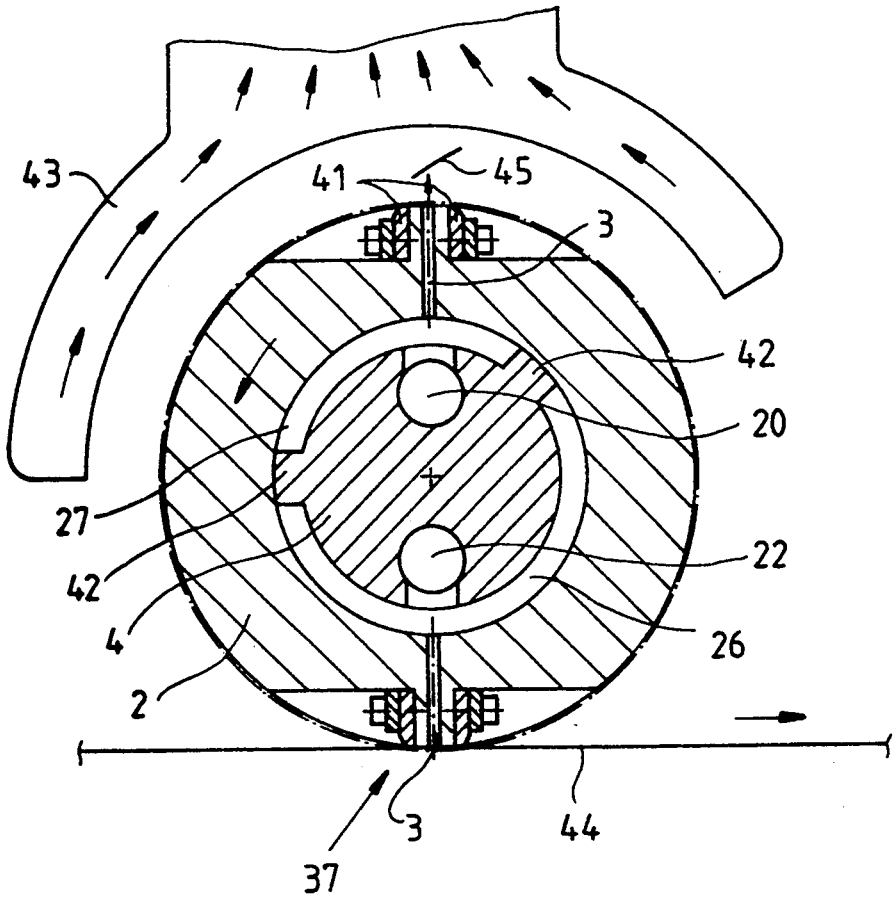
FIG. 6 shows a waste piece drawn off from the circumference of the cylinder jacket.

The manner of operation of the solution according to the invention will be explained diagrammatically below in FIGS. 4–6.

Figure 4:
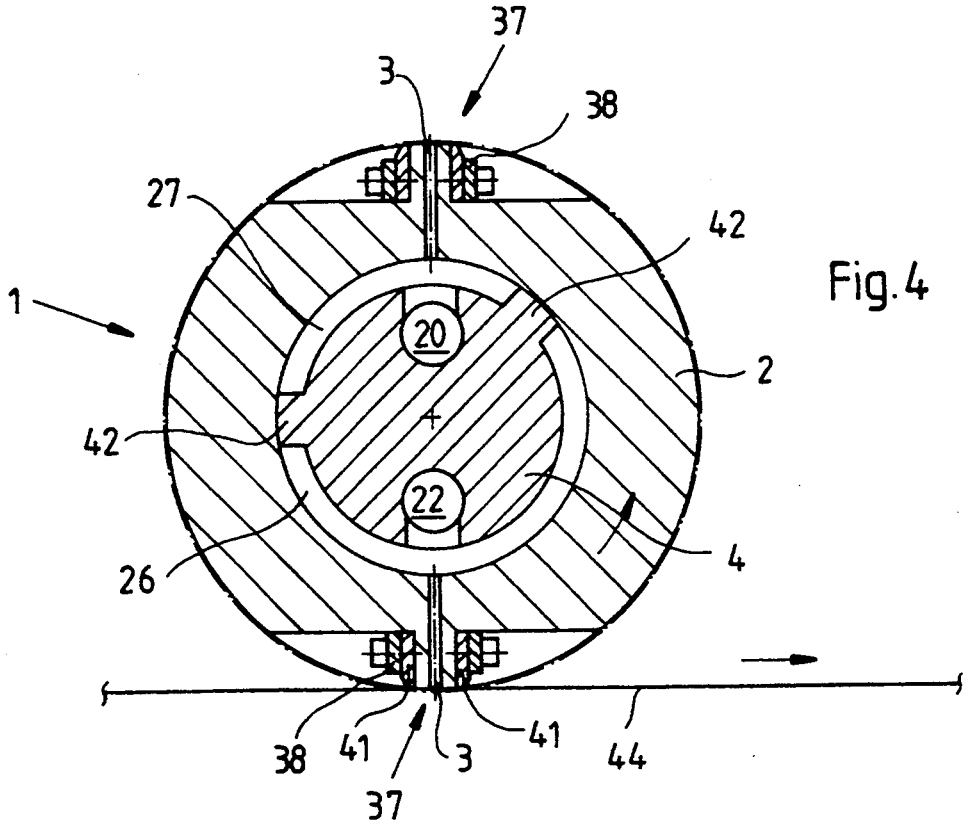
FIG. 4 is a pair of knives on the circumference of the cylinder jacket shown during cutting.

FIG. 4 shows the cylinder jacket 2 which is mounted on the cylinder shaft 4 and can be driven separately. The suction chamber 26 and the pressure chamber 27 are separated from each other by sealing strips 42, shown diagrammatically. The cylinder shaft 4 is passed through by a blast air hole 20 and a suction air hole 22 which are permanently acted on. Pairs of knives 37—for instance in this case two—are arranged opposite each other on the circumference of the cylinder jacket 2. The holes 3 exit on the circumference of the cylinder jacket 2 between the individual pairs of knives 37. In the condition shown here, a web 44 of printed stock moves past a pair of knives 37. The holes 3 which are associated with the pair of knives 37 are connected to the suction chamber 26. Upon the cutting by the knife 41 with a bottom knife—not shown here—one unit is cut off from the web 44 of printed stock. The waste strip 45 which is cut out between two printed units by the cut between second knife 41 and bottom knife and which extends in the axial direction of the cutting cylinder 1 is at this stage aspirated by the holes 3. After a turn of 90°, as shown in FIG. 5, the waste strip 45 is outside the cutting zone and is conveyed upward. The suction chamber 26 is still connected with the holes 3 in the cylinder jacket 2 which aspirate the waste strip 45, whereby the waste strip 45 is held on the circumference. Upon a further turning of the area of the cylinder jacket 2 which takes up the waste strip 45, it reaches the sealing strip 41 adjacent which there is the pressure chamber 27. There now takes place an immediate blowing of air through the holes 3 of the cylinder jacket 2. The waste strip 45, supported by the centrifugal force acting on it, is thereby detached from the circumference of the cylinder jacket 2. The suction hood 43 arranged above the cutting cylinder 1 draws the waste strip 45 off so that it is removed in reliable manner from the cylinder jacket 2. The suction hood 43 extends advantageously over a region which corresponds to the shape and extent of the pressure chamber 27; this assures the highest reliability of conveyance and handling of the waste strip 45.

At the same time the pair of knives 37 which is opposite the pair of knives 37 guiding the waste strip 45 cuts a waste strip 45 out of the web 44 of stock. The holes 3 of the lower pair of knives 37 are connected to the suction chamber 26 of the cylinder shaft 4 and the strip 45 of material which is to be cut off next is aspirated.

The switching of the type of air, whether vacuum or blast air, thus takes place without a switching apparatus and merely by the rotation of the cylinder jacket 2 relative to the cylinder shaft 4 which can be fixed in its position. The air volume to be reversed can thus be kept small; furthermore, the switching of suction air and blast air occurs close to the place where the air is needed. There are no duct systems in which the air volumes might be caused to vibrate so that the action of blast air or suction air enters into effect immediately after the switching on the cylinder jacket 2 in the region of the holes 3 between the cutting edges of the knives 41. Accordingly, there are no switch time delays, therefore the waste strips 45 which are to be conveyed are aspirated and detached under well-defined conditions.

While various preferred embodiments of the present invention have been disclosed above, it is contemplated that other embodiments may be encompassed by the concept of the invention, in particular that more than one pressure and vacuum chamber could be provided. It is also contemplated that a variety of sealing means, not just sealing strips, could be provided, as long as the sealing means provided for appropriate vacuum and pressure containment, which may vary depending on the effectiveness of the vacuum and pressure sources.

What is claimed is:

1. A device for the controlled removal of pieces of waste material comprising:

a non-rotatable cylinder shaft having an outer surface;

a cylinder jacket having an inner surface and an outer surface and having at least one through-hole extending between the inner surface and the outer surface of the cylinder jacket, the cylinder jacket rotatable around the cylinder shaft;

a sealer for sealing the outer surface of the cylinder shaft and the inner surface of the cylinder jacket;

a torque support for variably fixing the cylinder shaft in a non-rotatable position; and the outer surface of the cylinder shaft, the inner surface of the cylinder jacket and the sealer defining a pressure chamber and a vacuum chamber, so that upon rotation of the cylinder jacket around the cylinder shaft the at least one through-hole alternately connects with the pressure chamber and the vacuum chamber.

2. The device as recited in claim 1 wherein the cylinder shaft has a blast air hole and a suction air hole, the blast air hole communicating with the pressure chamber and the suction air hole communicating with the vacuum chamber.

3. The device as recited in claim 2 further comprising a blast air feed line to provide blast air to the blast air hole, and a suction air line to provide suction to the suction air hole.

4. The device as recited in claim 1 wherein the sealing means comprises at least two sealing strips disposed between the outer surface of the cylinder shaft and the inner surface of the cylinder jacket.

5. The device as recited in claim 4 wherein the sealing strips extend axially over approximately the entire length of the cylinder shaft.

6. The device as recited in claim 4 wherein the sealing strips can be variably fixed to alter the size of the pressure and vacuum chambers.

7. The device as recited in claim 1 wherein the cylinder jacket has two rows of through-holes, each row of through-holes spaced equally apart circumferentally.

8. The device as recited in claim 1 further comprising antifriction bearings for rotatably supporting the cylinder jacket on the cylinder shaft.

9. The device as recited in claim 1 further comprising a cylinder pin fixed to the cylinder jacket and a belt pulley arranged on the cylinder pin to provide for the drive of the cylinder jacket.

10. The device as recited in claim 1 further comprising a suction device positioned apart from the cylinder jacket.

11. The device as recited in claim 1 wherein the cylinder jacket has a row of through-holes extending axially along approximately the entire length of the cylinder jacket.

12. The device as recited in claim 1 wherein the cylinder jacket has two through-holes, the two through-holes spaced equally apart circumferentially.

13. A device for the controlled removal of pieces of waste material comprising:

a non-rotatable cylinder shaft having an outer surface;

a cylinder jacket having an inner surface and an outer surface and having at least one through-hole extending between the inner surface and the outer surface of the cylinder jacket, the cylinder jacket rotatable around the cylinder shaft;

at least two sealing strips disposed between the outer surface of the cylinder shaft and the inner surface of the cylinder jacket, the sealing strips extending axially over approximately the entire length of the cylinder shaft; and the outer surface of the cylinder shaft, the inner surface of the cylinder jacket and the sealing strips defining a pressure chamber and a vacuum chamber, so that upon rotation of the cylinder jacket around the cylinder sleeve the at least one through-hole alternately connects with the pressure chamber and the vacuum chamber, wherein the sealing strips can be variably fixed to alter the size of the pressure and vacuum chambers.

* * * * *